US008113623B2

(12) United States Patent
Tamaki et al.

(10) Patent No.: US 8,113,623 B2
(45) Date of Patent: Feb. 14, 2012

(54) LIQUID EJECTING APPARATUS

(75) Inventors: Shuichi Tamaki, Nagoya (JP); Tadanobu Chikamoto, Nagoya (JP); Akira Shinoda, Obu (JP); Noritsugu Ito, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 379 days.

(21) Appl. No.: 12/359,206

(22) Filed: Jan. 23, 2009

(65) Prior Publication Data

US 2009/0184998 A1 Jul. 23, 2009

(30) Foreign Application Priority Data

Jan. 23, 2008 (JP) ..... 2008-012114

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS 7,311,377 B2 * 12/2007 Takagi ..... 347/33
2005/0116972 A1 * 6/2005 Suzuki ..... 347/9
2007/0076047 A1 * 4/2007 Katada ..... 347/33

FOREIGN PATENT DOCUMENTS

JP 2007-203557 A 8/2007

* cited by examiner

*Primary Examiner* — Matthew Luu
*Assistant Examiner* — Alejandro Valencia
(74) *Attorney, Agent, or Firm* — Baker Botts L.L.P.

(57) ABSTRACT

A liquid ejecting apparatus, including: a medium conveying mechanism which conveys a medium in a first direction; a head pair composed of two liquid ejecting heads respectively having liquid ejection surfaces in which liquid ejection areas are respectively formed, the two heads having respective one end portions overlapping each other as viewed in the first direction, and disposed such that the respective one end portions are adjacent to each other in the first direction; two wipers for wiping the respective ejection surfaces; and a wiper moving mechanism configured to move the two wipers in mutually opposite directions, wherein the ejection areas partly overlap each other as viewed in the first direction, wherein, when each wiper is placed by the wiper moving mechanism at a wiping start position at which each wiper does not face the corresponding ejection surface, the two wipers partly overlap each other as viewed in the first direction, and wherein, when each wiper is placed at a wiping complete position at which each wiper does not face the corresponding ejection surface, the two wipers overlap each other as viewed in a second direction perpendicular to the first direction.

8 Claims, 6 Drawing Sheets

LIQUID EJECTING APPARATUS

CROSS REFERENCE TO RELATED APPLICATION

The present application claims priority from Japanese Patent Application No. 2008-012114 which was filed on Jan. 23, 2008, the disclosure of which is herein incorporated by reference to its entirety.

BACKGROUND OF THE INVENTION

1. Field of the Invention

The present invention relates in general to a liquid ejecting apparatus including liquid ejecting heads which eject a liquid.

2. Description of Related Art

A known liquid droplet ejecting apparatus has a plurality of wiper blades for wiping nozzle surfaces of a plurality of heads arranged in a zigzag fashion. Each of the wiper blades in the above-indicated liquid droplet ejecting apparatus is disposed at widthwise one end of a corresponding one of the heads so as to extend over a dimension of the head as measured in its longitudinal direction, namely, extends over a longitudinal dimension of the head. The wiper blade is configured to move in a direction perpendicular to the longitudinal direction, whereby the nozzle surface of the corresponding head is wiped by the wiper blade.

In the liquid droplet ejecting apparatus indicated above, a space into which each wiper blade is retracted upon initiation or completion of wiping is secured by enlarging a distance between two heads adjacent to each other in the direction perpendicular to the longitudinal direction. The arrangement inevitably increases the size of the device in terms of the direction perpendicular to the longitudinal direction.

SUMMARY OF THE INVENTION

A need has arisen for a liquid ejecting apparatus which is downsized in terms of a certain direction.

According to one embodiment herein, a liquid ejecting apparatus may comprise: a recording-medium conveying mechanism configured to convey, in a first direction, a recording medium on which an image is to be recorded; a head pair composed of two liquid ejecting heads which respectively have liquid ejection surfaces in which liquid ejection areas facing the recording medium are respectively formed, which have respective one end portions overlapping each other as viewed in the first direction, and which are disposed such that the respective one end portions overlapping each other are adjacent to each other in the first direction; two wipers respectively for wiping the ejection surfaces of the respective two liquid ejecting heads; and a wiper moving mechanism configured to move the two wipers such that the two wipers are moved in mutually opposite directions while being held in contact with the respective liquid ejection surfaces, wherein the liquid ejection areas of the respective liquid ejection surfaces partly overlap each other as viewed in the first direction, wherein, when each of the two wipers is placed by the wiper moving mechanism at a wiping start position where said each of the two wipers does not face a corresponding one of the liquid ejection surfaces, the two wipers partly overlap each other as viewed in the first direction, and wherein, when each of the two wipers is placed by the wiper moving mechanism at a wiping complete position where said each of the two wipers does not face the corresponding one of the liquid ejection surfaces, the two wipers overlap each other as viewed in a second direction perpendicular to the first direction.

In the liquid ejecting apparatus constructed as described above, the two wipers are disposed so as to overlap each other as viewed in the second direction when each of the two wipers is located at the wiping complete position. Accordingly, it is possible to reduce a space, in terms of the first direction, occupied by the two wipers when each of the two wipers is located at the wiping complete position. Therefore, the liquid ejecting device can be downsized in terms of the first direction. Further, the arrangement reduces a distance between the two liquid ejecting heads in the head pair in the first direction, thereby avoiding deviation in attachment positions of the liquid ejected from one and the other of the two ink-jet heads of the head pair, which deviation is caused when the recording medium that is being conveyed is inclined with respect to the first direction. Thus, the image quality can be improved.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE EMBODIMENT

Figure 1:
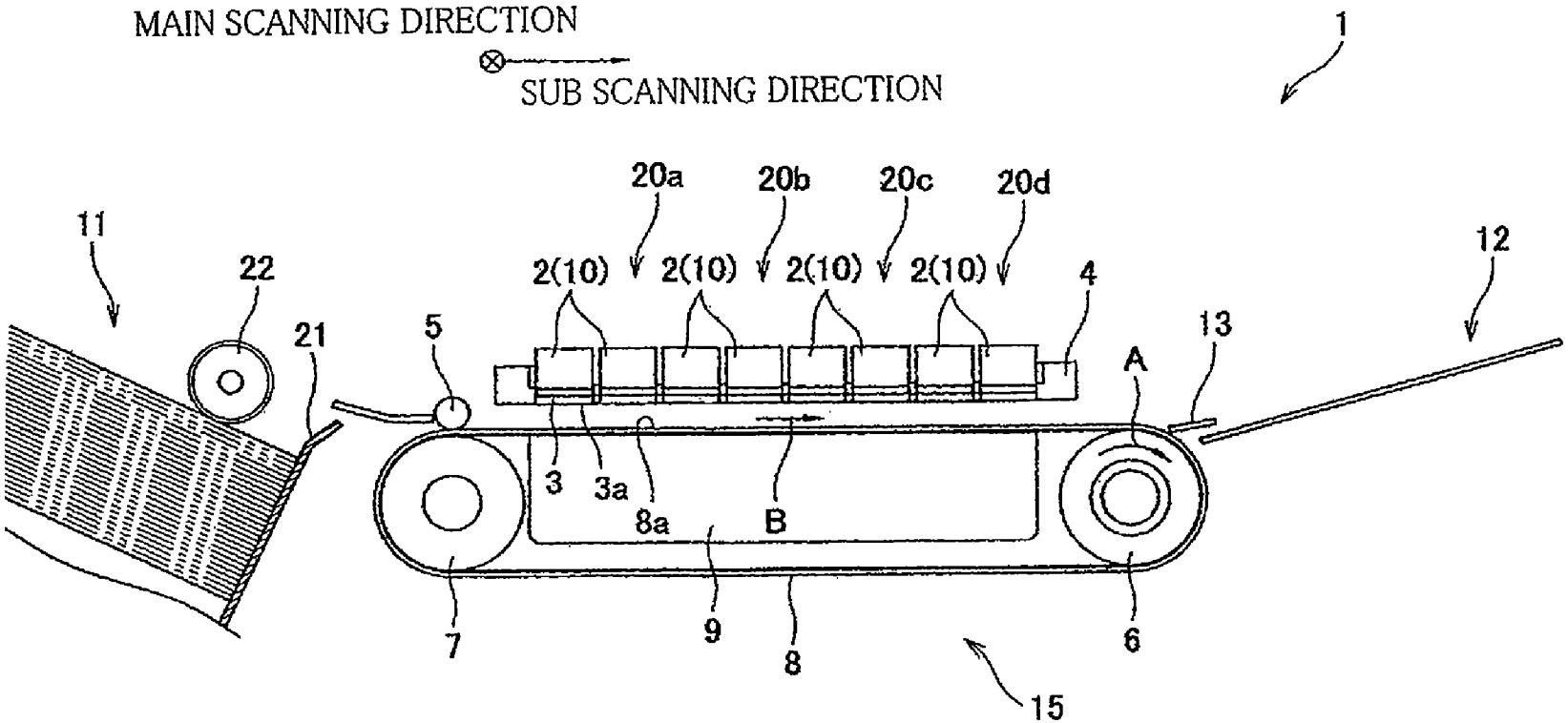
FIG. 1 is a schematic side elevational view in cross section showing an ink-jet printer according to one embodiment.

Referring to the drawings, there will be explained an ink-jet printer according to one embodiment. The ink-jet printer as a liquid ejecting apparatus is configured to record characters and images by ejecting ink as a liquid to a recording sheet as a recording medium.

1. Schematic Structure of Ink-Jet Printer

Referring first to FIG. 1, there will be explained an overall structure of the ink-jet printer according to the present embodiment. The ink-jet printer generally indicated at 1 in FIG. 1 is a color ink-jet printer of a line type that includes four head pairs 20*a*, 20*b*, 20*c*, 20*d*, each pair including two ink-jet heads 2 (each as a liquid ejecting head). The ink-jet printer 1 includes a sheet feeding mechanism 11 disposed on its left side as seen in FIG. 1 and a sheet discharging portion 12 disposed on its right side.

Inside the ink-jet printer 1, there is formed a sheet conveying path through which the recording sheet is conveyed from the sheet feeding mechanism 11 to the sheet discharging portion 12. The sheet feeding mechanism 11 has a pick-up roller 22. When a pick-up motor (not shown) is driven, the pick-up roller 22 is rotated so as to feed an uppermost one of the recording sheets accommodated in a sheet tray 21 from the left to the right in FIG. 1. A sheet conveying mechanism 15 as a recording-medium conveying mechanism is disposed in the middle of the sheet conveying path. The sheet conveying mechanism 15 is configured to convey the recording sheet in a sub scanning direction, namely, in a sheet-conveyance direction B, as a first direction, and includes a pair of belt rollers 6, 7 and an endless conveyor belt 8 that is wound around the belt rollers 6, 7 so as to be stretched therebetween.

The conveyor belt 8 has an outer circumferential surface, namely, a sheet conveying surface 8*a*, which is treated with silicone to give adhesion property thereto. A pressing roller 5 is disposed immediately downstream of the sheet feeding mechanism 11 so as to face the belt roller with the conveyor belt 8 interposed therebetween. The pressing roller 5 is configured to rotate while being in contact with the sheet conveying surface 8*a* of the conveyor belt 8, for pressing each sheet fed from the sheet feeding mechanism 11 onto the sheet conveying surface 8*a*. The sheet pressed onto the sheet conveying surface 8*a* is retained on the sheet conveying surface 8*a* owing to the adhesion property of the same 8*a* and is conveyed in the sheet-conveyance direction B while facing ink ejection surfaces 3*a* of the respective ink-jet heads 2. The sheet retained on the sheet conveying surface 8*a* of the conveyor belt 8 is separated therefrom by a separation plate 13 and is finally conveyed to the sheet discharging portion 12. In this instance, the belt roller 6 disposed at a downstream portion of the ink-jet printer 1 in the sheet-conveyance direction is being rotated clockwise, i.e., in a direction indicated by an arrow A in FIG. 1, by a drive force transmitted from a feed motor (not shown).

Figure 2:
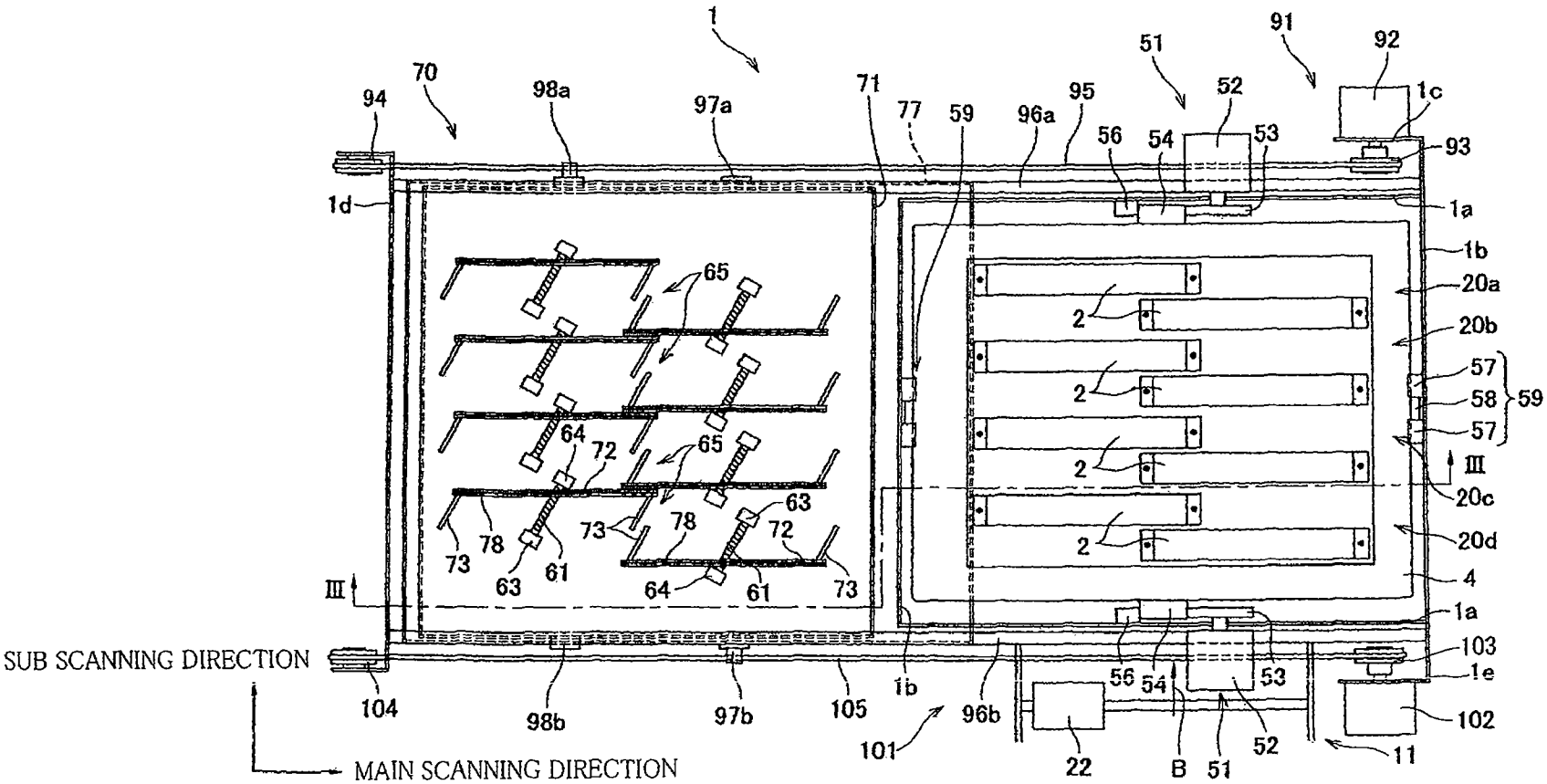
FIG. 2 is a plan view showing a part of the ink-jet printer of FIG. 1.
Figure 3:
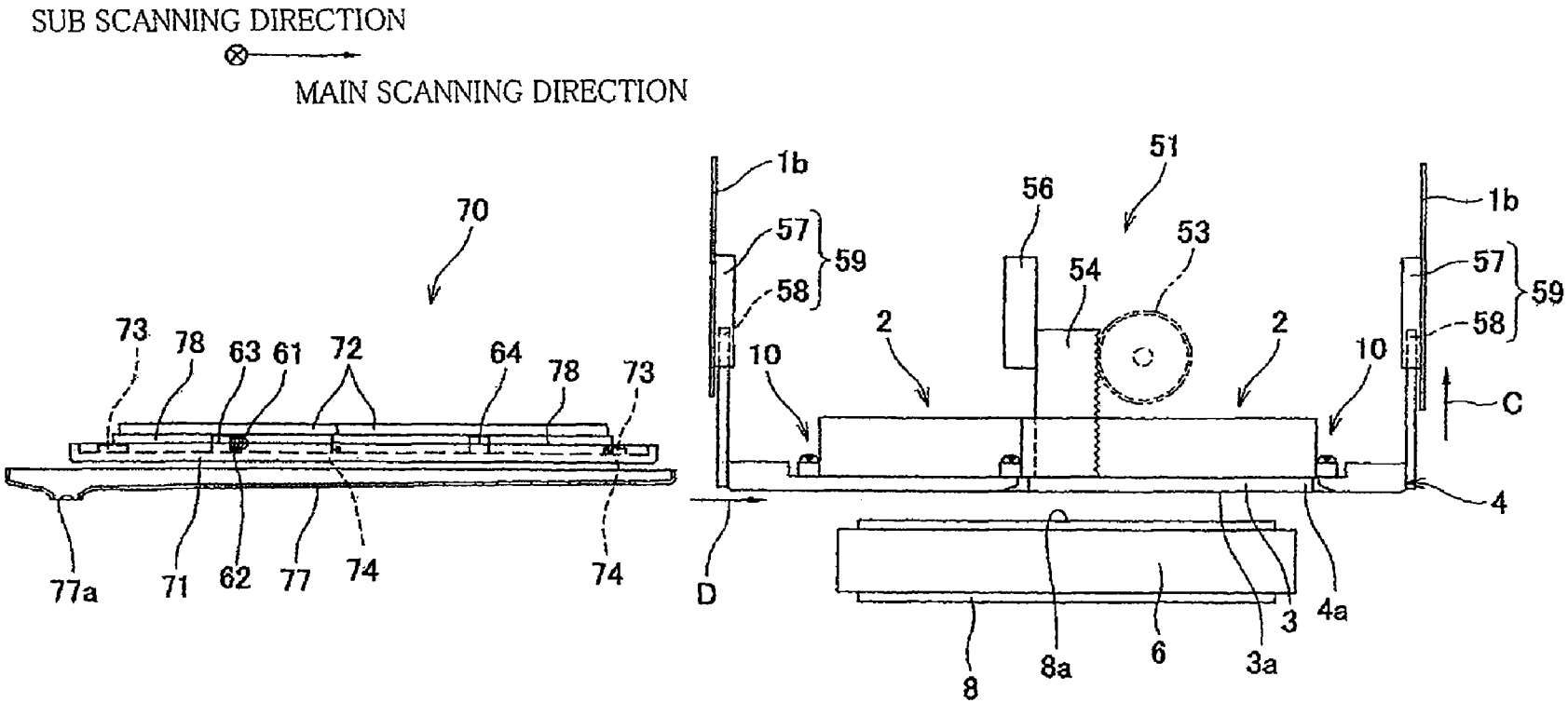
FIG. 3 is a cross-sectional view taken along line III-III of FIG. 2.

As shown in the plan view of FIG. 2, each of the eight ink-jet heads 2 has a generally rectangular parallelepiped shape which is long in a main scanning direction perpendicular to the sub scanning direction, namely, in a left-to-right direction in FIG. 2, as a second direction. As shown in FIGS. 1 and 3, each ink-jet head 2 has a head body 3 at its lower end.

The head body 3 is constituted by a flow-path unit in which are formed a plurality of individual ink passages including a plurality of pressure chambers and an actuator which gives a pressure to the ink in the pressure chambers, the flow-path unit and the actuator being bonded to each other. The head body 3 has a generally rectangular parallelepiped shape which is long in the main scanning direction. On the bottom surface of each head body 3, namely, on the ejection surface 3*a* of each head body 3, there are formed: a plurality of nozzles 3*b* with a minute diameter through which the ink is ejected; and an ink ejection area 3*c* comprised of the nozzles 3*b*.

Figure 4:
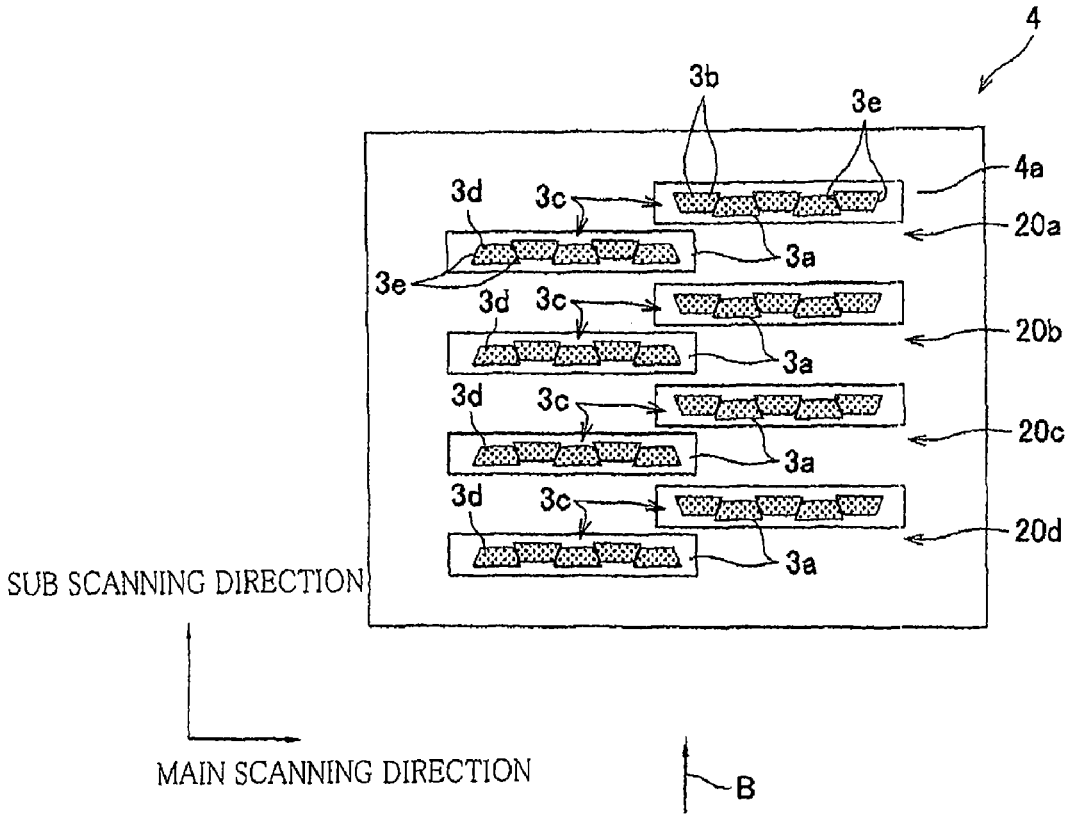
FIG. 4 is a plan view of ink-jet heads and a frame as viewed from the bottom.

As shown in FIG. 4, each ink ejection area 3*c* is constituted by five trapezoidal regions 3*d*, each as a polygonal region, which are separated from each other. Each trapezoidal region 3*d* has two oblique lines that are inclined with respect to the main scanning direction. The ten trapezoidal regions 3*d* of the two heads 2 belonging to the head pair 20*a* are disposed such that any two oblique lines adjacent to each other in the main scanning direction are parallel with each other and overlap each other as viewed in the sub scanning direction and such that the five trapezoidal regions 3*d* in each ink-jet head 2 in the head pair 20*a* are arranged in two rows, that is, the ten trapezoidal regions 3*d* in the two ink-jet heads 2 are arranged in four rows. The trapezoidal regions 3*d* in each of the other head pairs 20*b*-20*d* are similarly disposed.

As shown in FIGS. 1 and 3, a reservoir unit 10 for temporarily storing the ink is fixed to the upper surface of each head body 3. The reservoir unit 10 is longer than the head body 3 so as to protrude from respective longitudinal opposite ends of the corresponding head body 3. Each reservoir unit 10 is fixed to a frame 4 at its protruded portions such that the ejection surface 3*a* of the corresponding head body 3 on which the reservoir unit 10 is disposed is exposed downward through a corresponding one of through-holes formed in the frame 4 which will be explained. The ejection surface 3*a* of each head body 3 is flush with the bottom surface of the frame 4.

As shown in FIGS. 2-4, the frame 4 has a thin-walled or recessed portion formed at a central part thereof opening upward in the vertical direction. As described above, the through-holes are formed through the recessed portion so as to correspond to the locations of the eight ink-jet heads 2. As shown in FIG. 4, each ink-jet head 2 is exposed in a lower surface 4*a* of the frame 4 through a corresponding one of the through-holes. The recessed portion of the frame 4 is shaped to protrude inward from the inner periphery of the frame 4 surrounding the recessed portion.

Each head body 3 is disposed such that the ejection surface 3*a* and the sheet conveying surface 8*a* of the conveyor belt 8 which face each other are parallel with each other and such that a slight clearance is formed between the ejection surface 3*a* and the conveyor belt 8. The clearance partially constitutes the sheet conveying path. When the sheet conveyed by the conveyor belt 8 while being retained on the sheet conveying surface 8*a* of the conveyor belt 8 passes immediately below the eight head bodies 3 in order, inks of mutually different colors are ejected to the upper surface, namely, the recording surface, of the sheet, whereby an intended color image is formed on the sheet.

The two ink-jet heads 2 belonging to each of the head pairs 20*a*-20*d* are disposed such that one end portions of the respective two ink-jet heads 2 overlap each other as viewed in the sub scanning direction and such that the overlapping one end portions of the respective two ink-jet heads 2 are adjacent to each other in the sub scanning direction, as shown in FIGS. 2 and 4. In other words, the eight ink-jet heads 2 of the four head pairs are disposed such that the eight ejection surfaces 3*a* of the respective eight ink-jet heads 2 are arranged in a zigzag fashion, each row extending in the sub scanning direction and including four of the eight ejection surfaces 3*a*, and such that the four ejection surfaces 3*a* in one of the two rows do not overlap the four ejection surfaces 3*a* in the other of the two rows as viewed in the main scanning direction, namely, such that the four ejection surfaces 3*a* in one of the two rows and the four ejection surfaces 3*a* in the other of the two rows are shifted from each other in the sub scanning direction. In other words, the four ejection surfaces 3*a* in one of the two rows and the four ejection surfaces in the other of the two rows do not align with each other as viewed in the main scanning direction. In the arrangement, one head pair is constituted by the two ink-jet heads 2 that are disposed such that the respective one end portions thereof overlap each other as viewed in the sub scanning direction and such that the overlapping respective one end portions thereof are adjacent to each other in the sub scanning direction. As shown in FIG. 4, the four head pairs 20*a*, 20*b*, 20*c*, and 20*d* are arranged in the sub scanning direction.

At the overlapping one end portions of the two ink-jet heads 2 belonging to one 20*a* of the four head pairs 20*a*-20*d*, the respective ink ejection areas 3*c* partially overlap each other as viewed in the sub scanning direction. According to the arrangement, all of the nozzles 3*b* are disposed so as to be spaced apart from each other by a prescribed equal distance over the entire width of the sheet, in spite of the fact that the nozzles 3 are distributed over one and the other of the two different ink-jet heads 2. The ink-jet printer 1 of the present embodiment is capable of performing color printing of 600 dpi in the main scanning direction. The two ink-jet heads 2 of each of the other three head pairs 20*b*, 20*c*, and 20*d* are similarly disposed.

The color of the ink to be ejected from the two ink-jet heads 2 of each head pair varies from one head pair to another. In other words, the four head pairs 20*a*-20*d* eject mutually different four colors of inks, i.e., magenta, yellow, cyan, and black, and the inks of the different colors are superposed on the sheet being conveyed, whereby the color printing is performed.

2. Frame Moving Mechanism

As shown in FIGS. 2 and 3, the frame 4 is supported by a pair of frame moving mechanisms 51 provided on the printer 1, so as to be movable in the vertical direction, i.e., in a direction perpendicular to the sheet plane of FIG. 2. The frame moving mechanisms 51 are disposed on opposite sides of the frame 4 in the sub scanning direction with the eight ink-jet heads 2 interposed therebetween. Each frame moving mechanism 51 includes a head motor 52 as a drive source for moving the frame 4 in the vertical direction, a pinion gear 53 fixed to the shaft of the head motor 52, a rack gear 54 meshing with the pinion gear 53, a guide 56 disposed such that the rack gear 54 is interposed between the guide 56 and the pinion gear 53.

The head motors 52 of the respective frame moving mechanisms 51 are fixed to respective main body frames 1*a* of the ink-jet printer 1. The main body frames 1*a* as a pair are disposed so as to face each other in the sub scanning direction. Each rack gear 54 extends in the vertical direction and is fixed at its lower end to a side surface of the frame 4 facing the corresponding main body frame 1*a*. One side face of the rack gear 54 remote from the pinion gear 53 is held in slidable contact with the guide 56 that is fixed to a corresponding one of the main body frames 1*a*.

When the pinion gears 53 are rotated in a forward or a reverse direction with the respective head motors 52 synchronously driven, the rack gears 54 are moved upward or downward. Along with the movement of the rack gears 54, the frame 4 is moved upward or downward together with the eight ink-jet heads 2.

A pair of guide units 59 are disposed on opposite ends of the frame 4 in the main scanning direction. Each guide unit 59 includes a bar member 58 and a pair of guide members 57 between which the bar member 58 is interposed. As shown in FIG. 3, the guide members 57 extend in the vertical direction and are fixed to respective main body frames 1*b* of the ink-jet printer 1 as a pair. The main body frames 1*b* are disposed so as to face each other in the main scanning direction. Like the guide members 57, the bar member 58 extends in the vertical direction and is fixed to a side surface of the frame 4 facing the corresponding main body frame 1*b* at the corresponding end of the frame 4 in the main scanning direction indicated above. The bar member 58 is held in slidable contact with the pair of guide members 57.

The guide units 59 prevent the ink ejection surfaces 3*a* of the respective ink-jet heads 2 from being inclined with respect to the sheet conveying surface 8*a* of the conveyor belt 8 when the frame 4 is vertically moved by the frame moving mechanisms 51. That is, when the frame 4 and the ink-jet heads 2 are vertically moved by the frame moving mechanisms 51, the ink ejection surfaces 3*a* can be kept parallel with the sheet conveying surface 8*a*, thereby enhancing the attaching accuracy with which the ink is attached to the sheet in the printing operation.

The frame 4 moved by the frame moving mechanisms 51 are normally located at a print position (shown in FIG. 3) at which the eight ink-jet heads 2 eject the ink toward the sheet for the printing operation. Upon maintenance of the ink-jet heads 2 (including a purging operation in which the ink is forcibly ejected from the ink-jet heads 2 and a wiping operation in which the ejection surfaces 3*a* are wiped to remove the ink adhering thereto), the frame 4 is moved by the frame moving mechanisms 51 in a direction indicated by an arrow C in FIG. 3, so that the frame 4 is located at a maintenance position whose height level is higher than the print position.

3. Structure of Maintenance Unit

Next, there will be explained a maintenance unit 70 for performing maintenance of the ink-jet heads 2. As shown in FIGS. 2 and 3, the maintenance unit 70 is disposed on the left side of the ink-jet heads 2 and includes a box-like tray 71 which is horizontally movable and open upward.

Before the maintenance unit 70 is horizontally moved rightward, the frame 4 is moved upward in advance (i.e., in a direction indicated by the arrow C in FIG. 3) to the head maintenance position, whereby there is provided, between the eight ink ejection surfaces 3*a* and the conveyor belt 8, a space for accommodating the maintenance unit 70. Thereafter, the maintenance unit 70 is horizontally moved in a direction indicated by an arrow D in FIG. 3.

A waste-ink receiving tray 77 is disposed right below the tray 71. The waste-ink receiving tray 77 has a size that permits the tray 71 to be accommodated therein in plan view. An ink drain hole 77*a* is formed at one end (i.e., a left-side end in FIG. 3) of the waste-ink receiving tray 77 that is remote from the ink-jet heads 2. The ink flowed into the waste-ink receiving tray 77 is discharged into a waste-ink reservoir (not shown) through the ink drain hole 77*a*.

There are arranged, in the tray 71, eight wipers 72 for wiping the ejection surfaces 3*a* of the respective eight ink-jet heads 2. Each wiper 72 is formed of an elastic material such as a rubber and has a length slightly larger than a dimension of each ejection surface 3*c* as measured in the main scanning direction. The longitudinal direction of each wiper 72 is parallel to the longitudinal direction of each ink-jet head 2. Each wiper 72 is disposed at a corresponding one of outer sides (in the sub scanning direction) of a corresponding one of the head pairs 20*a*-20*d*. More specifically, the wipers 72 are disposed such that each wiper 72 at a wiping start position in the maintenance operation is located at one side of the corresponding ink-jet head 2 in the sub scanning direction, which one side is remote from another ink-jet head 2 belonging to the same head pair, namely, each wiper 72 at the wiping start position faces a boundary between the recessed portion of the frame 4 and the corresponding ink-jet head 2 or each wiper 72 at the wiping start position faces a part of the recessed portion of the frame 4 partly defining the corresponding through-hole and located outside the boundary. The eight wipers 72 are arranged in two rows, each row extending in the sub scanning direction and including four of the eight wipers 72. A part of the wipers 72 in one of the two rows and a part of the wipers in the other of the two rows partly overlap each other as viewed in the sub scanning direction. The eight wipers 72 are supported by respective eight mount members 78 provided on the tray 71.

Figure 5:
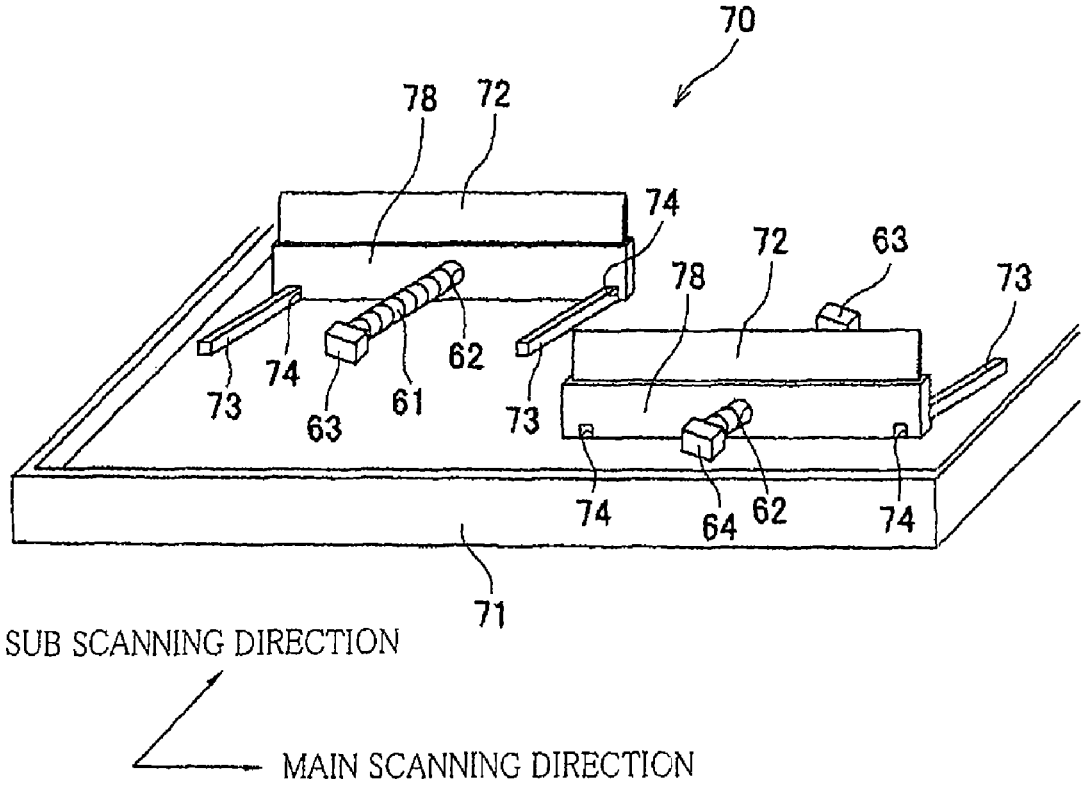
FIG. 5 is a partial perspective view of a maintenance unit.

Each mount member 78 has a rectangular parallelepiped shape extending in a direction of extension of each wiper 72. As shown in FIGS. 2 and 5, two guide grooves 74 are formed in longitudinal opposite ends (in the main scanning direction) of each mount member 78. Two guide shafts 73 are inserted through the respective two guide grooves 74, whereby the mount member 78 is slidable on the tray 71 while being guided by the rail-like two guide shafts 73. The two guide shafts 73 are fixed to the tray 71 and inclined by a prescribed angle with respect to the main scanning direction.

As shown in FIG. 2, the sixteen guide shafts 73 in total are arranged, on the tray 71, in three rows each of which extends in the sub scanning direction, in the following manner. The four guide shafts 73 in the leftmost row are disposed overlapping each other as viewed in the sub scanning direction, so as to correspond to the left-side end portions of the respective four ink-jet heads 2 in the left-side row. The eight guide shafts 73 in the middle row are disposed overlapping each other as viewed in the sub scanning direction, so as to correspond to the right-side end portions of the four ink-jet heads 2 in the left-side row and the left-side end portions of the four ink-jet heads 2 in the right-side row. The four guide shafts 73 in the rightmost row are disposed overlapping each other as viewed in the sub scanning direction, so as to correspond to the right-side end portions of the four ink-jet heads 2 in the right-side row.

A through-hole 62 is formed at a longitudinally middle portion of each mount member 78 through the thickness thereof along the direction of extension of the guide shafts 73. A screw shaft as a ball screw 61 is inserted into and screwed with the through-hole 62. A drive motor 63 is connected to one of opposite ends of each screw shaft 61 while a support member 64 is connected to the other of the opposite ends of the same 61.

As apparent from FIG. 2, each screw shaft 61 is disposed so as to overlap, as viewed in the main scanning direction, one ink-jet head 2 that corresponds to one mount member 78 through which is formed the through-hole 62 into which the screw shaft 61 is inserted. The drive motor 63 and the support member 64 connected to one and the other of the opposite ends of each screw shaft 61 are fixed to the tray 71 such that a line connecting the drive motor 63 and the support member 64 is parallel to the direction of extension of the guide shafts 73. In the arrangement, when the drive motor 63 is driven and the screw shaft 61 is thereby rotated, the corresponding mount member 78 moves, together with the corresponding wiper 72, along a linear track that is inclined by the prescribed angle with respect to the main scanning direction, while sliding along the corresponding guide shaft 73. In this instance, two wipers 72 corresponding to the same head pair move in mutually opposite directions along the direction of extension of the guide shafts 73. Further, the two wipers 72 move toward a boundary between the two ink-jet heads 2 of the head pair.

That is, a wiper moving mechanism 65 is constituted by two mount members 78, two drive motors 63, two support members 64, four guide shafts 73, and two shaft screws 61, which correspond to two wipers 72 for one head pair. The wiper moving mechanism 65 is provided for each of the four head pairs.

When the maintenance operation is not performed on the ink-jet heads 2, the maintenance unit 70 is located at a retracted position as shown in FIGS. 2 and 3 at which the maintenance unit 70 does not face the ink-jet heads 2. When the maintenance operation is performed, the maintenance unit 70 is moved horizontally from the retracted position to a maintenance position at which the maintenance unit 70 faces the ejection surfaces 3*a* of the respective ink-jet heads 2. On this occasion, since the frame 4 is located at the head maintenance position, the leading ends of the respective wipers 72 do not contact the ejection surfaces 3*a*.

The tray 71 is slidably supported by a pair of guide shafts 96*a*, 96*b* extending in the main scanning direction. The tray 71 is provided with two bearing members 98*a*, 98*b* which protrude outward from respective side surfaces of the tray 71 that are opposed to each other in the sub scanning direction. Each of the guide shafts 96*a*, 96*b* are fixed at its opposite ends to a body frame 1*d* located at the leftmost position in FIG. 2 and the rightmost one of the pair of main body frames 1*b*. The two guide shafts 96*a*, 96*b* are disposed parallel to each other between those body frames 1*b*, 1*d*.

There will be next explained a first horizontally moving mechanism 91 for moving the tray 71 in the horizontal direction as indicated by the arrow D in FIG. 3 along the guide shafts 96*a*, 96*b*. As shown in FIG. 2, the first horizontally moving mechanism 91 includes a tray motor 92, a motor pulley 93, an idle pulley 94, and a timing belt 95.

The tray motor 92 is fixed to an attachment part 1*c* formed at one end of the rightmost one of the pair of body frames 1*b* that extends parallel to the sub scanning direction. The motor pulley 93 is connected to the tray motor 92 and is rotated when the tray motor 92 is driven. The idle pulley 94 is rotatably supported by the main body frame 1*d* located at the leftmost position in FIG. 2. The timing belt 95 is disposed parallel to the guide shaft 96*a* and is wound around the motor pulley 93 and the idle pulley 94 so as to be stretched therebetween. The bearing member 98*a* provided on the tray 71 is connected to the timing belt 95.

In the arrangement, when the tray motor 92 is driven, the motor pulley 93 is rotated in a forward or a reverse direction and the timing belt 95 thereby runs. As the timing belt 95 runs, the tray 71 connected to the timing belt 95 via the bearing member 98*a* is moved in the horizontal direction. In other words, the wipers 72 in the tray 71 are moved in the horizontal direction.

The waste-ink receiving tray 77 is also slidably supported by the pair of the guide shafts 96*a*, 96*b* extending in the main scanning direction. The waste-ink receiving tray 77 is provided with two bearing members 97*a*, 97*b* so as to protrude outward from respective side surfaces of the waste-ink receiving tray 77 that are opposed to each other in the sub scanning direction.

There will be next explained a second horizontally moving mechanism 101 for moving the waste-ink receiving tray 77 in the horizontal direction as indicated by the arrow D in FIG. 3 along the guide shafts 96*a*, 96*b*. As shown in FIG. 2, the second horizontally moving mechanism 101 includes a tray motor 102, a motor pulley 103, an idle pulley 104, and a timing belt 105.

The tray motor 102 is fixed to an attachment part 1*e* formed at one end of the rightmost one of the pair of body frames 1*b* that extends parallel to the sub scanning direction. The motor pulley 103 is connected to the tray motor 102 and is rotated when the tray motor 102 is driven. The idle pulley 104 is rotatably supported by the main body frame 1*d* located at the leftmost position in FIG. 2. The timing belt 105 is disposed parallel to the guide shaft 96*b* and is wound around the motor pulley 103 and the idle pulley 104 so as to be stretched therebetween. The bearing member 97*b* provided on the waste-ink receiving tray 77 is connected to the timing belt 105.

In the arrangement, when the tray motor 102 is driven, the motor pulley 103 is rotated in a forward or a reverse direction and the timing belt 105 thereby runs. As the timing belt 105 runs, the waste-ink receiving tray 77 connected to the timing belt 105 via the bearing member 97*b* is moved in the horizontal direction. In other words, the tray 71 and the waste-ink receiving tray 77 are movable in horizontal direction by being driven independently of each other.

Next, the maintenance operation by the maintenance unit 70 will be explained.

When the purging operation is performed for recovery of the ink-jet heads 2 suffered from ejection failure, the frame 4 is initially moved upward by the frame moving mechanisms 51. On this occasion, the two head motors 52 are synchronously driven thereby rotating the respective pinion gears 53 in the forward direction, i.e., in a clockwise direction in FIG. 3. As a result, the respective rack gears 54 are moved upward along with the rotation of the respective pinion gears 53, and the frame 4 fixed to the rack gears 54 are moved upward together with the eight ink-jet heads 2. Thereafter, the head motors 52 are ceased to rotate when the frame 4 and the ink-jet heads 2 reach the head maintenance position.

Thus, the above-indicated space is formed between the ejection surfaces 3*a* and the conveyor belt 8 in which the maintenance unit 70 can be disposed. The bottom surfaces of the ejection surfaces 3*a* of the ink-jet heads 2 and the bottom surface of the frame 4 at the head maintenance position do not contact the leading ends of the wipers 72 when the maintenance unit 70 is moved to the maintenance position.

Subsequently, the tray motor 102 of the second horizontally moving mechanism 101 is driven to run the timing belt 105 for thereby moving the waste-ink receiving tray 77 to the maintenance position. When the waste-ink receiving tray 77 has reached the maintenance position, the tray motor 102 is ceased to be driven.

Thereafter, pumps (not shown) are driven to forcibly feed the ink in respective ink tanks (not shown) to the respective ink-jet heads 2, thereby performing the purging operation in which the ink is ejected from the nozzles 3*b* of the ink-jet heads 2 toward the waste-ink receiving tray 77. The ink ejected to the waste-ink receiving tray 77 is discharged through the ink drain hole 77*a*. The purging operation eliminates plugging of the nozzles 3*b* suffered from ejection failure and thickening of the ink in the nozzles 3*b*. However, a part of the ink remains as ink droplets on the ejection surfaces 3*a*.

For removing the ink adhering to and remaining on the ejection surfaces 3*a*, the wiping operation by the wipers 72 is performed. Initially, the tray motor 92 of the first horizontally moving mechanism 91 is driven to run the timing belt 95 for thereby moving the tray 71 to the maintenance position. When the tray 77 has reached the maintenance position, the tray motor 92 is ceased to be driven.

Subsequently, the ink-jet heads 2 are moved downward by the frame moving mechanisms 51, so that the ejection surfaces 3*a* of the ink-jet heads 2 are disposed at a position where the leading ends of the wipers 72 are capable of contacting the respective ejection surfaces 3*a*. On this occasion, the two wipers 72 which correspond to the two ink-jet heads 2 that belong to the head pair 20*a*, for instance, are disposed on opposite (outer) sides of the head pair 20*a* in the sub scanning direction, when each of the two wipers 72 is located at the wiping start position at which each wiper 72 is not opposed to the corresponding ejection surface 3*a*. In the present embodiment, each wiper 72 at the wiping start position is opposed to the part of the recessed portion of the frame 4 partially defining the corresponding through-hole formed in the same 4, in the vicinity of one side surface of the corresponding ink-jet head 2, which one side surface is remote from another ink-jet head belonging to the same head pair, in the sub scanning direction. In this instance, the two wipers 72 partly overlap each other as viewed in the sub scanning direction as indicated by solid lines in FIG. 6.

When the drive motors 63 are driven and the corresponding shaft screws 61 are thereby rotated, the two wipers 72 are moved along the linear track that is inclined with respect to the main scanning direction by the prescribed angle, while being held in contact with the corresponding ejection surfaces 3*a*. Accordingly, the two wipers 72 respectively wipe hatched regions (FIG. 6) in the ejection surfaces 3 while moving in mutually opposite directions. In this instance, the direction of the movement of the two wipers 72 is identical with the direction of extension of two oblique lines 3*e* of two trapezoidal regions 3*d* which belong to one and the other of the two ink-jet heads 2 of the same head pair and which overlap as viewed in the sub scanning direction, the two oblique lines 3*e* overlapping as viewed in the sub scanning direction. According to the arrangement, the wipers 72 can be made compact with the smallest length. Thus, the wiping operation on the ejection surfaces 3*a* is performed by the wipers 72.

Figure 6:
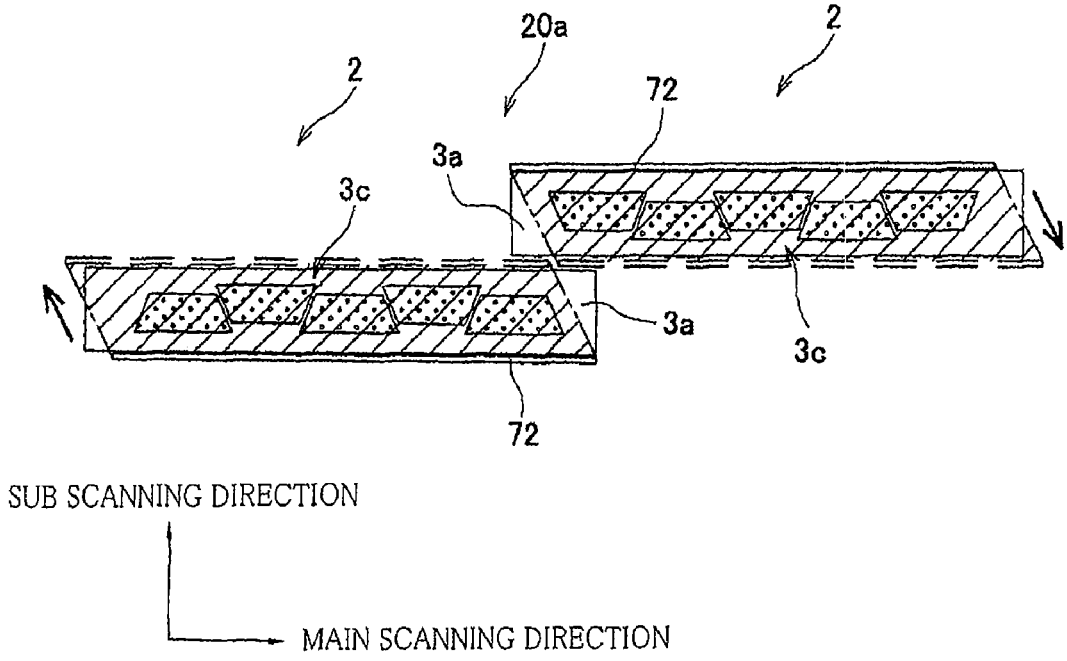
FIG. 6 is a view showing an operation of wipers for wiping respective ejection surfaces.

When the wiping operation is completed, the two wipers 72 are located at respective wiping complete portions where the two wipers 72 overlap each other, between the two ink-jet heads 2, as viewed in the main scanning direction, as indicated by broken lines in FIG. 6. The two wipers 72 corresponding to one and the other of the two ink-jet heads 2 belonging to each of the other head pairs 20*b*, 20*c*, 20*d* similarly perform the wiping operation.

Thereafter, the ink-jet heads 2 are moved upward by the frame moving mechanisms 51. Then the tray 71 and the waste-ink receiving tray 71 are moved leftward respectively by the first and second horizontally moving mechanisms 91, 101, namely, moved from the maintenance position to the retracted position.

In the ink-jet printer 1 according to the present embodiment, when the two wipers 72 corresponding to the same head pair are located at the respective wiping complete position, the two wipers 72 are disposed so as to overlap each other as viewed in the main scanning direction. The arrangement is capable of reducing a space that is occupied by the two wipers 72 in terms of the sub scanning direction when the two wipers 72 are located at the respective wiping complete positions, thereby downsizing the ink-jet printer 1 in terms of the sub scanning direction. If a space occupied by the two ink-jet heads 2 in the sub scanning direction is large, there may arise a large difference in timing of attachment of the ink ejected from one and the other of the two ink-jet heads belonging to the same head pair, thereby causing deviation in the attaching positions of the ink ejected from one and the other of the two ink-jet heads belonging to the same head pair. The present embodiment, however, can reduce a space between the two ink-jet heads 2 in the sub scanning direction. Accordingly the above-indicated difference in timing of attachment of the ink can be made small and the deviation in the ink attaching positions can be accordingly made small, ensuring an improvement in the image quality.

Further, each of the two wipers 72 corresponding to the same head pair is moved along the linear track from the wiping start position to the wiping complete position, whereby the ejection surfaces 3*a* can be wiped in a relatively short time in the simplified manner.

In the illustrated embodiment, each head pair is composed of the two ink-jet heads 2 that respectively eject inks of the same color. Accordingly, even when the ink removed by one of the two wipers 72 that corresponds to one of the two ink-jet heads in the same head pair spatters upon completion of the wiping operation, there arise no problems due to ink mixture since the other of the two ink-jet heads 2 in the same head pair that is adjacent to that one wiper 72 in question ejects the ink of the same color.

The two wipers 72 and the wiper moving mechanism 65 are provided for each of the head pairs, so that the wiping operation can be performed on the ejection surfaces 3*a* of the two ink-jet heads 2 of each head pair that respectively eject the inks of the same color. In other words, the arrangement prevents ink mixture which may be caused by wiping the ejection surfaces 3*a* of all of the ink-jet heads 2 with two wipers.

When the two wipers 72 corresponding to each head pair are located at the respective wiping start positions, the two wipers 72 are disposed on opposite sides of the head pair in the sub scanning direction. When the two wipers 72 corresponding to each head pair are located at the respective wiping complete positions, the two wipers 72 are disposed between the two ink-jet heads of the head pair. Accordingly, the arrangement ensures high efficiency in terms of the disposition space of the two wipers 72, thereby reducing the size of the ink-jet printer 1.

Some modifications will be explained. In the illustrated embodiment, the two wipers 72 corresponding to one head pair are linearly moved by the corresponding wiper moving mechanism 65. The wipers 72 may be moved in any directions as long as the ejection surfaces 3*a* can be wiped. For instance, the wipers 72 may be moved along a sectoral track. The direction of the movement of the wipers 72 may be different from the direction of extension of the two oblique lines 3*e* which overlap each other as viewed in the sub scanning direction and which belong to the two different ink-jet heads 2 of the same head pair.

In the illustrated embodiment, the plurality of regions constituting each ink ejection area 3*c* have a trapezoidal shape. The regions may have any shapes having two oblique lines inclined with respect to the main scanning direction, such as a parallelogram and a hexagon.

In the illustrated embodiment, the ink-jet printer 1 has the four head pairs from which the mutually different four colors of inks are respectively ejected. The number of the head pairs may be arbitrarily determined.

All of the wipers 72 may be simultaneously moved. Alternatively, the wipers 72 may be moved independently for each head pair.

In the illustrated embodiment, the wiping start position of each wiper 72 is located at the part of the recessed portion of the frame 4 partly defining the corresponding through-hole, in the vicinity of the side surface of the corresponding ink-jet head 2. The wiper 72 at the wiping start position may be located at one end of the corresponding ejection surface 3*a* in the sub scanning direction that does not include the ink ejection area 3*c* (the trapezoidal regions 3*d*). According to the arrangement, the wiper 72 does not wipe the part of the recessed portion of the frame 4 partly defining the through-hole to which the ink does not substantially adhere, so that the wiper 72 is protected from being worn due to wiping of the dry part. Moreover, the ink-jet heads 2 in the same head pair can be disposed more closely relative to each other, contributing to downsizing of the ink-jet printer 1.

In the illustrated embodiment, the two wipers 72 are disposed for each head pair. The wiping operation on all of the head pairs may be performed by only one pair of wipers 72. In this instance, the wiper pair is moved from one head pair to another head pair. After completion of the wiping operation, the ink-jet heads 2 may be driven to eject a prescribed number of ink droplets (i.e., to perform a flushing operation), so that ink mixture can be avoided.

In the illustrated embodiment, the principle of the present invention is applied to the ink-jet printer having the plurality of ink-jet heads which eject the ink from the nozzles. The principle of the invention may be applied not only to the ink-jet heads, but also to various liquid ejecting apparatus such as those having a plurality of liquid ejecting heads which eject an electrically conductive paste to form a fine wiring pattern on a substrate, which eject an organic illuminant on a substrate to form a high-definition display, or which eject an optical resin on a substrate to form a micro electronic device such as an optical waveguide.

What is claimed is:

1. A liquid ejecting apparatus, comprising:

a recording-medium conveying mechanism configured to convey, in a first direction, a recording medium on which an image is to be recorded;

a head pair composed of two liquid ejecting heads which respectively have liquid ejection surfaces in which liquid ejection areas facing the recording medium are respectively formed, which have respective one end portions overlapping each other as viewed in the first direction, and which are disposed such that the respective one end portions overlapping each other are adjacent to each other in the first direction;

two wipers respectively for wiping the ejection surfaces of the respective two liquid ejecting heads; and a wiper moving mechanism configured to move the two wipers such that the two wipers are moved in mutually opposite directions while being held in contact with the respective liquid ejection surfaces, wherein the liquid ejection areas of the respective liquid ejection surfaces partly overlap each other as viewed in the first direction, wherein, when each of the two wipers is placed by the wiper moving mechanism at a wiping start position where said each of the two wipers does not face a corresponding one of the liquid ejection surfaces, the two wipers partly overlap each other as viewed in the first direction, and wherein, when each of the two wipers is placed by the wiper moving mechanism at a wiping complete position where said each of the two wipers does not face the corresponding one of the liquid ejection surfaces, the two wipers overlap each other as viewed in a second direction perpendicular to the first direction.

2. The liquid ejecting apparatus according to claim 1, wherein each of the two wipers is linearly moved by the wiper moving mechanism from the wiping start position to the wiping complete position.

3. The liquid ejecting apparatus according to claim 1, wherein the two liquid ejecting heads of the head pair respectively eject liquids of the same color.

4. The liquid ejecting apparatus according to claim 3, comprising a plurality of head pairs, each as the head pair, which are disposed along the first direction, wherein a color of the liquids to be ejected respectively from the two liquid ejecting heads of each of the plurality of head pairs varies from one head pair to another.

5. The liquid ejecting apparatus according to claim 4, wherein the two wipers and the wiper moving mechanism are provided for each of the plurality of head pairs.

6. The liquid ejecting apparatus according to claim 1, wherein each of the liquid ejection areas is constituted by a plurality of polygonal regions each of which has two oblique lines inclined with respect to the second direction and which are separated from each other, wherein all of the plurality of polygonal regions belonging to the two liquid ejecting heads in the head pair are arranged in four rows each extending in the second direction, such that any two oblique lines adjacent to each other in the second direction are parallel with each other and overlap each other as viewed in the first direction, and wherein a direction in which the two wipers are moved by the wiper moving mechanism is identical with a direction of extension of two oblique lines which overlap each other as viewed in the first direction and which belong to one and the other of the two liquid ejecting heads of the head pair.

7. The liquid ejecting apparatus according to claim 1, wherein the two wipers are disposed at one and the other of opposite sides of the head pair in the first direction when each of the two wipers is located at the wiping start position, and wherein the two wipers are disposed between the two liquid ejecting heads in the head pair when each of the two wipers is located at the wiping complete position.

8. The liquid ejecting apparatus according to claim 1, wherein the two wipers are moved by the wiper moving mechanism in a direction that is oblique with respect to the first direction.

* * * * *